US005677896A

United States Patent [19]

Nunes

[11] Patent Number: 5,677,896

[45] Date of Patent: Oct. 14, 1997

[54] DESK TOP LAMP AND CLOCK

[76] Inventor: Brendon G. Nunes, 467 Westney Road S., Unit 3, Ajax, Ontario, Canada, L1S 6V7

[21] Appl. No.: 681,362

[22] Filed: Jul. 23, 1996

[51] Int. Cl.[6] ..... G04B 47/00; F21S 1/12

[52] U.S. Cl. ..... 368/10; 362/413; D26/54

[58] Field of Search ..... 368/10.3, 276, 368/316–317; 362/410–414, 418–421; D26/51, 54

[56] References Cited

U.S. PATENT DOCUMENTS

| | | | |
|---|---|---|---|
| D. 354,231 | 1/1995 | Nunes . | |
| D. 364,354 | 11/1995 | Nunes . | |
| 5,124,899 | 6/1992 | Hale | 362/2.53 |
| 5,346,207 | 9/1994 | Heinen | 273/1.5 R |
| 5,375,103 | 12/1994 | Ulloa | 368/12 |

OTHER PUBLICATIONS

*What's What*, a Visual Glossary of the Physical World; Bragonier et al; Hammond Incorporated, 1981; p. 296.

1996 Spartus brochure.

Jul., 1977 Spartus catalog pages.

Photographs of prior art (1990 or earlier) novelty basketball baskets.

*Primary Examiner*—Vit W. Miska

*Attorney, Agent, or Firm*—Nixon & Vanderhye P.C.

[57] ABSTRACT

A novelty desk lamp simulates an actual basket assembly such a used in professional and college basketball. The desk lamp includes a base, a miniature basketball backboard, rim and net, the rim extending from a first face of a backboard, and the backboard having a second face opposite the first face, and a cantilever arm extending from the base and operatively connected to the backboard second face. A light source is mounted adjacent the backboard second face (e.g. directly to it and connected between the backboard and the arm) and is connectable by wires to a source of electrical power, such a household current or batteries. A control, such as a manually actuated switch, controls the supply of electrical power to the light source. The position of the light source with respect to the base can be adjusted by adjusting the position of the cantilever arm, as by pivoting the cantilever arm by using a linear actuator, such as a turn buckle. A novelty clock is also provided in which an LCD clock extending above the backboard is mounted to a support surface, such as by using a permanent magnet defining at least part of the backboard second face.

20 Claims, 4 Drawing Sheets

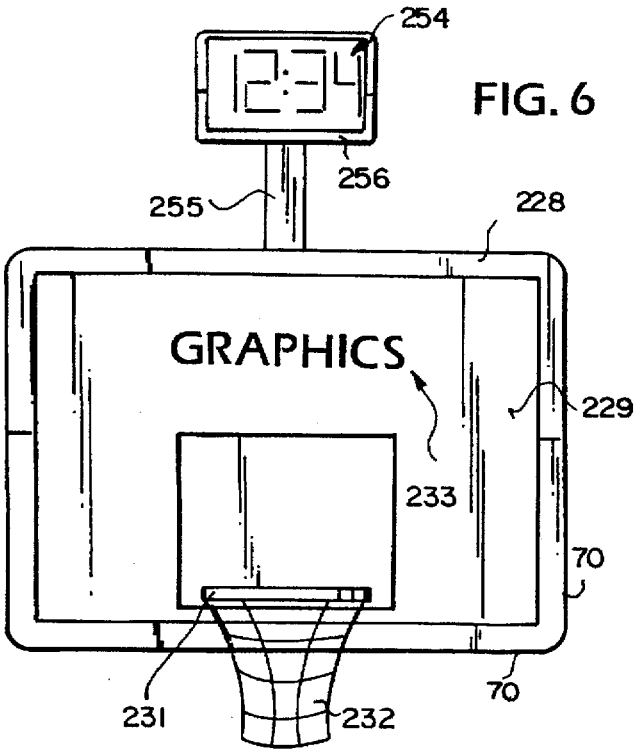
FIG. 6
FIG. 7
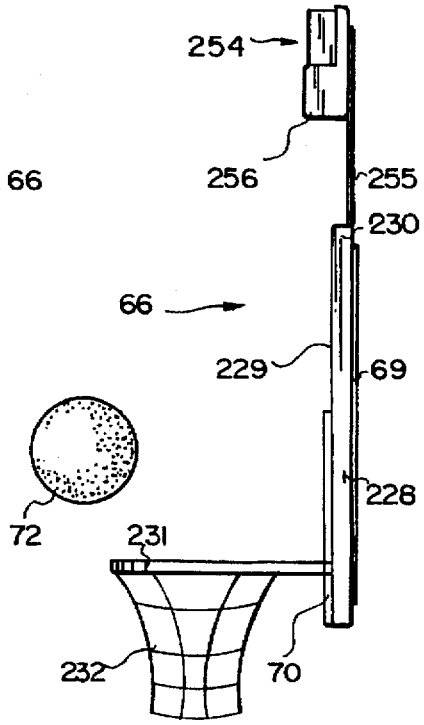
FIG. 8
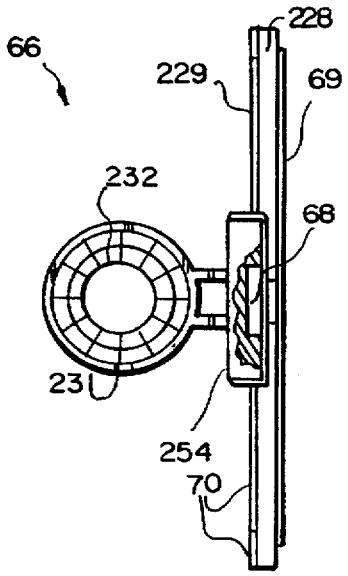

DESK TOP LAMP AND CLOCK

BACKGROUND AND SUMMARY OF THE INVENTION

In the design of many household articles it is important to keep other factors in mind aside from pure functionality of the household objects. For example it is desirable to make the objects aesthetic, to have them perform some amusement function in addition to the normal function they perform, and/or to use them for making a "statement" about their owner or user. It is for this reason that many novelty items are provided, such as the novelty clocks and thermometers shown in U.S. design Pat. Nos. 288,412 and 293,419.

According to the present invention, novelty items are provided which appeal to consumers having an interest in playing or viewing basketball. Basketball is one of the most popular sports worldwide, and draws player and fan interest from both sexes, all ages, and all classes of people. The novelty items according to the present invention simulate real basketball standards (also known as back stops or basket assemblies) not only to provide consumer appeal, but also to provide an amusement device as well as an otherwise functional household object.

According to one aspect of the present invention a basketball standard simulating a novelty desk lamp is provided. The desk lamp is dimensioned so that it has approximately the same dimensions as conventional "tensor" lights, or a like desk lamp, yet can be used as an amusement device while making a statement about the personality or interests of the owner, and while properly functioning as a desk lamp. An exemplary novelty desk lamp according to the present invention comprises the following components: A base. A miniature basketball backboard, rim and net, the rim extending from a first face of said backboard, and the backboard having a second face opposite the first face. A cantilever arm extending from the base and operatively connected to the backboard second face. A light source mounted adjacent the backboard second face and connectable by wires to a source of electrical power. And, a control for controlling the supply of electrical power to the light source.

The light source may comprise any conventional light source such as incandescent, fluorescent, halogen, or other known light bulbs, light emitting diodes, or the like. It may be powered by household current (either a 120 volt direct line connection, or through a transformer powered by 12 volts), by batteries, or both. The control for controlling the supply of electric power may comprise a manually actuated electrical switch (such as push button, alternate action, dimmer, toggle, or like switches), a condition responsive (noise, darkness, or the like) switch, or a computer or other automatic control.

The desk lamp may also further comprise a digital display clock capable of keeping time from at least 1:00 to 12:59; and means for mounting the clock so that it is positioned above the backboard and the digital display thereof is visible when viewing the backboard first face. The clock mounting means may comprise a removable mounting means for mounting the clock to the second face of the backboard (e.g. a bar slidable in a channel). The clock may be any suitable clock, but preferably comprises an LCD clock powered by a button battery. The means for mounting the clock mounts the clock so that it simulates the position of a shot clock on a full size basketball backboard.

The desk lamp may further comprise means for adjusting the position of the cantilever arm with respect to the base so that the position of the light source with respect to the base is adjusted. For example the adjusting means may comprise a simple telescopic adjustment such as in a music stand where the cantilever arm is substantially vertical. Where the novelty desk lamp is desired to most accurately simulate an actual basketball standard (such as used in professional and college play), the adjusting means comprises a pivotal connection between the cantilever arm and the base for allowing pivotal movement of the arm with respect to the base, and means for effecting pivoting action of the arm about the pivotal connection and retaining the arm in the position to which it has been pivoted. The means for effecting pivoting movement may comprise a linear actuator having first and second opposite ends, and pivotally connected at the first end to the arm, and pivotally connected at the second end to the base. The linear actuator may comprise a turn buckle, a fluidic piston and cylinder assembly, a friction fit or detented telescoping tube arrangement, a bar and sleeve arrangement, a high inertia (e.g. detented, spring pressed, friction bearing, etc.) rack and pinion, or like conventional structure. Alternatively the cantilever arm may be connected at a portion thereof opposite its pivot point from the miniature backboard to a wheel, gear, or wheel or gear sector, or lever, which is rotated or pivoted to any desired position and held in that position by any conventional detenting mechanism.

A weight may be provided disposed in the base for biasing the arm and backboard so that the backboard front face is maintained substantially vertical, the weight ensuring that despite the shorter fulcrum arm of the cantilever arm on the base side of the pivot than on the miniature backboard side of the pivot that the lamp will not tip over. Preferably basketball team indicating graphics (e.g. "Toronto Raptors" and logo, or "Northwestern University Wildcats" and logo, or the like) may be imaged on the backboard first face. Typically the light source is in a housing and the housing is affixed to the backboard second face. The base may have a horizontal surface engaging face, and the cantilever arm may have a first portion which extends from the base at an angle of between about 30°–60° to the base horizontal surface engaging face, and a second portion which extends substantially parallel to the base horizontal surface engaging face and is connected to the lamp. The lamp may further comprise functional braces (or elements simulating braces) connecting the arm directly to the backboard second face.

According to another aspect of the present invention a novelty clock is provided. The novelty clock may comprise a clock such as described above with respect to the desk lamp embodiment, with or without the light source, or it may a comprise an embodiment that is easily removably mounted to vertical surfaces. For example the novelty clock according to the invention may include the following components: A miniature basketball backboard, rim, and net, the rim extending from a first face of the backboard, and the backboard having a second face opposite the first face. A digital display clock capable of keeping time from at least 1:00 to 12:59. Means for mounting the clock so that it is positioned above the backboard and the digital display thereof is visible when viewing the backboard first face. And, means for mounting the backboard to a support surface.

The means for mounting the backboard to a support surface may comprise a permanent magnet defining at least part of the backboard second face, for example either magnetically or adhesively secured to the backboard second face, or actually forming a part of it, or integral with it. A foam strip may be mounted along the periphery of the bottom and part of the sides of the first face of the backboard so as to simulate a player-protecting foam strip on a full size basketball backboard when the first face is viewed head on. As with the desk lamp embodiment, the means for mounting the clock preferably mounts the clock so that it simulates the position of a shot clock on a full size basketball backboard, and the clock may comprise an LCD clock powered by a button battery. As with the desk lamp embodiment graphics are typically provided on the backboard first face.

The miniature basketball backboard, rim and net not only make a personality or interest statement of the owner, and/or are aesthetic, but also can provide amusement. A foam basketball of the size capable of passing through the rim may be provided with the desk lamp or clock so that one can "shoot baskets" with the miniature basketball standard.

It is the primary object of the present invention to provide a basketball simulating novelty clock and/or novelty desk lamp. This and other objects of the invention will become clear from an inspection of the detailed description of the invention and from the appended claims.

BRIEF DESCRIPTION OF THE DRAWINGS

FIG. 6 is a front view of an exemplary novelty clock, such as for mounting on a refrigerator, according to the present invention; and FIGS. 7 and 8 are rode and top views, respectively, of the novelty clock of FIG. 6.

DETAILED DESCRIPTION OF THE DRAWINGS

Figure 1:
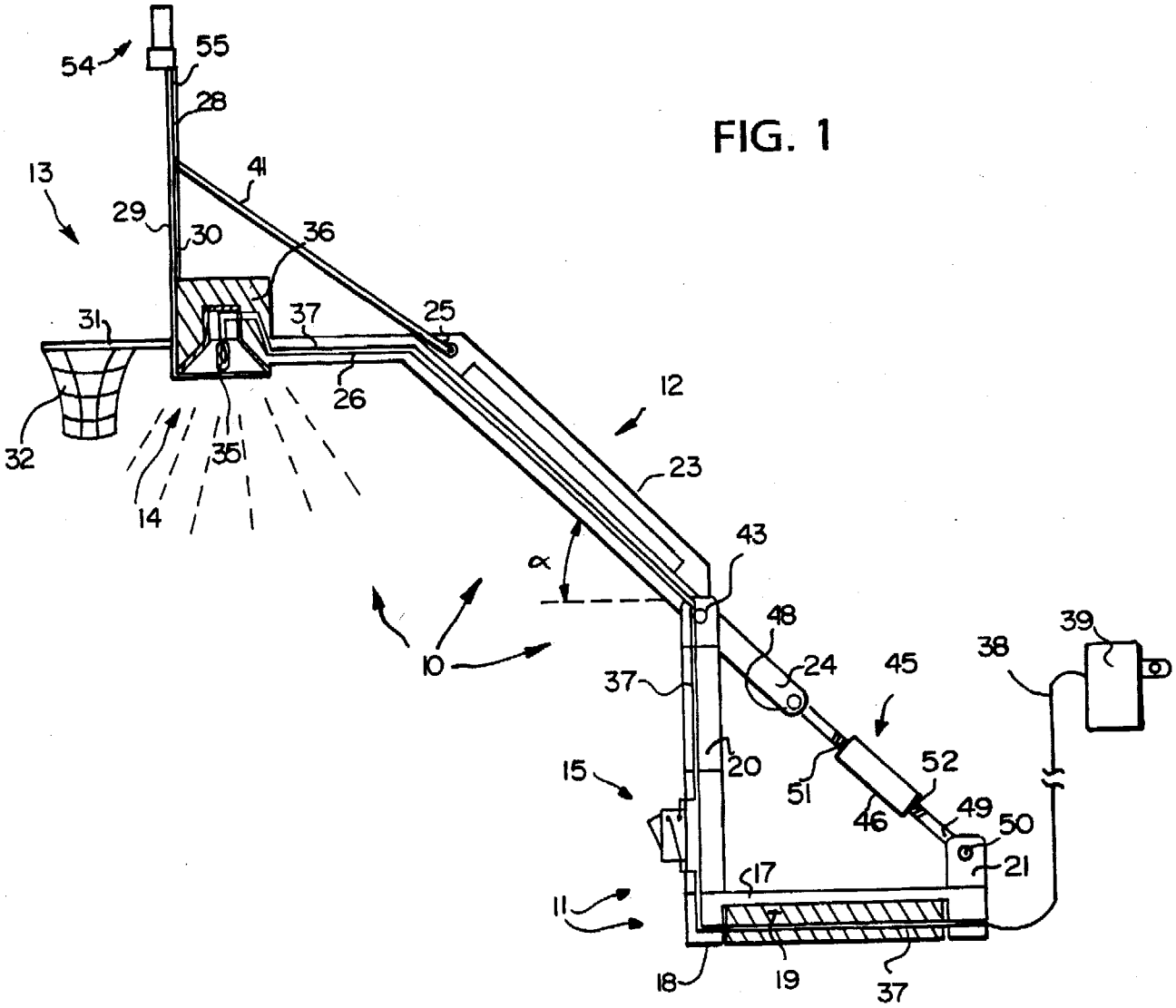
FIG. 1 is a side schematic view, partly in cross-section and partly in elevation, of an exemplary novelty desk lamp according to the present invention.
Figure 3:
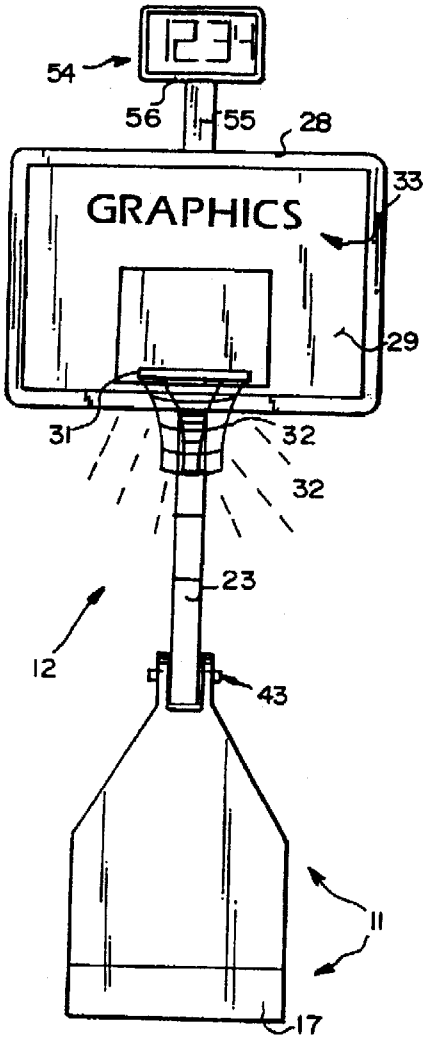
FIG. 3 is a front view of the lamp of FIGS. 1 and 2.
Figure 2:
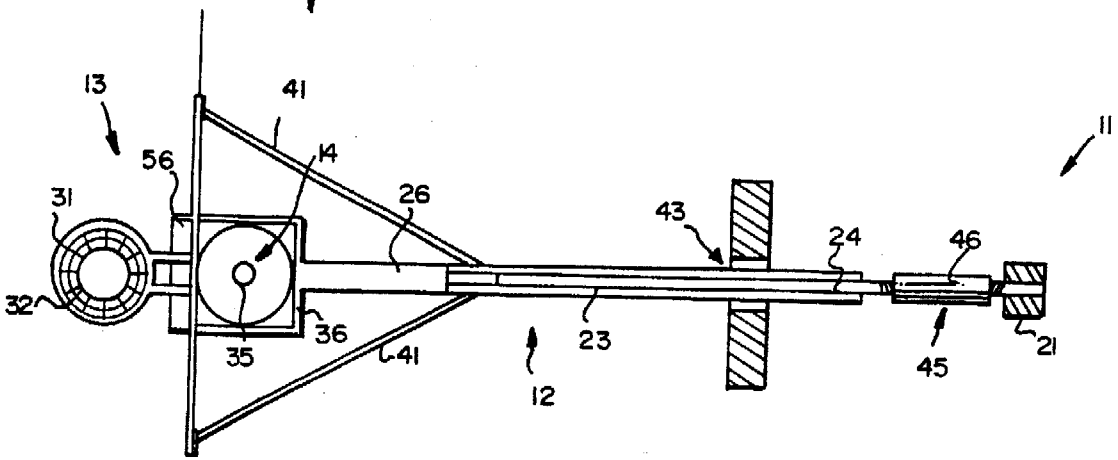
FIG. 2 is a bottom plan view of the desk lamp of FIG. 1 with the bottom of the base, which includes the weight, removed for clarity of illustration, and shown partly in cross-section.

An exemplary novelty desk lamp according to the present invention is shown generally by reference numeral 10 in FIGS. 1 through 3. The lamp 10 includes a base, shown generally by reference numeral 11, a cantilever arm, shown generally by reference numeral 12, a miniature basketball backboard, shown generally by reference numeral 13, a light source, shown generally by reference numeral 14, and a control which controls the supply of electrical power to the light source 14, such as the electrical switch 15.

The base 11, in the exemplary embodiment illustrated in FIGS. 1 through 3, includes a bottom portion 17, including a horizontal surface engaging face 18, and which may have a weight 19 therein. The base 11 also includes an upright support 20 from a front edge of the lower portion 17, and a pivot support 21. Typically the weight 19 is metal, dense ceramic, stone, or the like; the rest of the portions 17, 18, 20 and 21 may be made of any suitable material including metal, plastic, or wood.

The cantilever arm 12 extends from the base 11 to the backboard 13. While the cantilever arm 12 may be substantially vertical (and be adjusted such as in the manner in which a music stand is adjusted), preferably it comprises an arm that simulates a support unit of a conventional full size basketball standard. For example it may comprise a first portion 23 which has a first end 24 and a second end 25 and extends from the base 11 so that it makes an angle $\alpha$ of between 30°–60° to the base face 18. At the second end 25 of the first portion 23 it is connected to a second portion 26 which extends substantially (although not necessarily exactly depending upon the adjustment of the arm 12) parallel to the base face 18.

The miniature basketball backboard assembly 13 includes an actual backboard 28 having a first face 29 and a second face 30 opposite the first face 29, a rim 31, and net 32. Preferably on the face 29—as illustrated in FIG. 3—graphics 33 are imprinted. The graphics preferably are basketball team indicating graphics, such as "Toronto Raptors", "Northwestern Wildcats", or the like, in words, logo, or both words and logo. The rim 31 extends outwardly from the first face 29 adjacent the bottom of the backboard 28, as in a conventional full sized basketball standard.

The light source 14 preferably comprises a light bulb 35 mounted in a housing 36, both of which are conventional. The light bulb 35 may be of any conventional type, such as incandescent, fluorescent, halogen, or the like, or light emitting diodes or the like may be substituted in its place. The light bulb 35 is connected by wires, shown schematically at 37 in FIG. 1 to a source of electrical power. The source of electrical power may, for example, be dry cell batteries which provide the weight 37 in the base lower portion 17 or are otherwise positioned in the lamp 10, or an electrical cord 38 which plugs into household current. The cord 38 may directly plug in to household current (e.g. 120 volts A.C.) or if a 12 volt system is provided may plug in through a conventional transformer 39.

While the control 15 is illustrated as a conventional manually actuated electrical switch in FIG. 1—e.g. mounted on the upright portion 20 of the base 11—it may comprise any suitable device. If a manually actuated electrical switch it may be push button, toggle, alternate action, or of the dimmer type, or it may be a condition responsive (e.g. light, sound, heat, or the like) switch, or it may be an automatic control controlled by a timer, computer, or any other conventional automatic control device.

In order to provide a still further accurate simulation of a conventional basketball standard, elements simulating braces—such as the element 41 illustrated in FIGS. 1 and 2—may be provided. The elements 41 are connected between the arm 12 and the second face 30 of the backboard 28. The elements 41 may comprise actual functional braces rather than merely simulating braces depending upon their material, strength, and manner of connection to the backboard 28 and the arm 12.

The desk lamp 10 preferably also comprises means for adjusting the position of the cantilever arm 12 with respect to the base 11 so that the position of the light source 14 with respect to the base 11 (and the surface directly under the light source 14 which is to be illuminated) may be adjusted. Depending upon the particular nature of the cantilever arm 12 a wide variety of different types of adjustment mechanisms of a conventional nature, such as telescoping vertical tubes, with screw or frictional or detented engagements, may be provided. However when desiring to most accurately simulate a conventional basketball standard, a cantilever arm 12 preferably has the configuration illustrated in FIGS. 1 and 2, and a pivotal connection 43 is provided for connecting the arm portion 23 to the upright standard 20 of the base 11. The pivotal connection 43 may be any conventional pivotal connection such as a shaft, shaft stubs, protruding dimples, bearings, or the like. The adjustment means further comprises means for effecting pivoting action of the arm 12 about the pivotal connection 43 and retaining the arm 12 in the position to which it is pivoted. Such pivoting action effecting means are shown generally by reference numeral 45 in FIGS. 1 and 2.

The means 45 may comprise wheels, gears, wheel or gear segments, or lever arms, and may be associated with any conventional detenting mechanism such as slots in a plate, spring pressed balls or caps, cantilever springs, or the like. However in the preferred embodiment illustrated in FIGS. 1 and 2, the means for effecting pivoting action 45 preferably comprise a linear actuator 46 having a first end 47 pivotally connected at 48 to the arm portion 24, and a second end 49 pivotally connected at 50 to the base portion 21. In the embodiment actually illustrated in FIGS. 1 and 2 the linear actuator 46 comprises a conventional turn buckle having a center portion (to which the reference numeral 46 lead line actually extends) which is adjustable with respect to screw threaded portions 51, 52 on the rods defining the ends 47, 49, the screw threaded portions 51, 52 cooperating with internal threads (not shown) on the central section of the turn buckle (46). Alternatively the linear actuator 46 may comprise a fluidic piston and cylinder assembly, friction fit or detented telescoping tubes, a bar and sleeve, a high inertia (e.g. detented spring pressed, friction bearing, etc.) pinion and rack, or a like conventional structure. By actuating the linear actuator 46 the position of the light bulb 35 with respect to the surface underneath it which is to be illuminated may be adjusted.

Figures 4, 5:
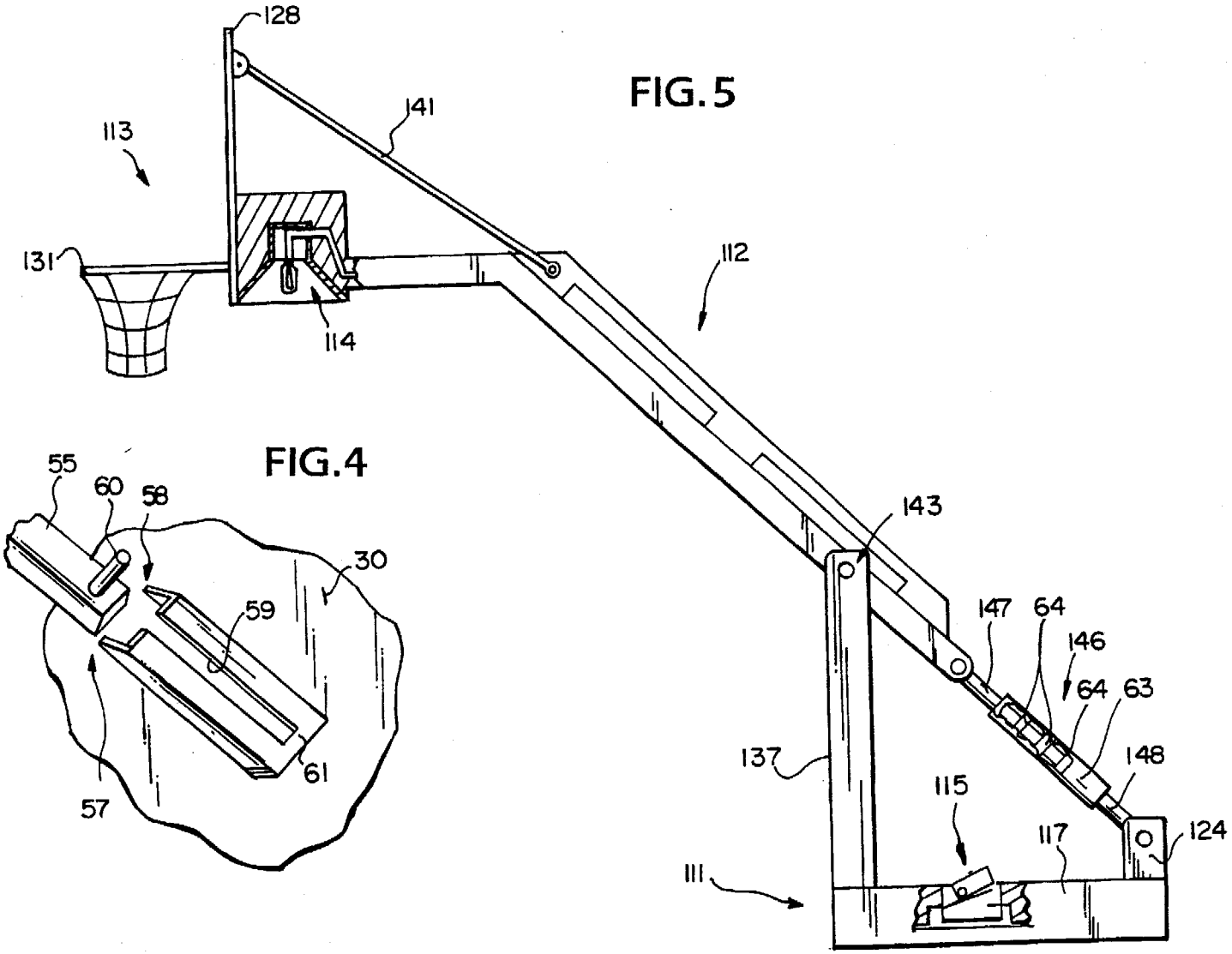
FIG. 4 is a detail perspective view showing an exemplary releasable connection between the clock support and the miniature backboard of the desk lamp of FIGS. 1 through 3.
FIG. 5 is a side schematic view, partly in cross-section and partly cut away for clarity of illustration, of a second embodiment of an exemplary desk lamp according to the present invention.

The desk lamp 10 also preferably comprises a digital display clock 54 capable of keeping time from at least 1:00 to 12:59 (that is all the minutes and hours of a conventional 12 hour cycle). For example the clock 54 may be a conventional LCD clock powered by a button battery. Means are provided for mounting the clock 54 so that it is positioned above the backboard 28 and the digital display thereof is visible when viewing the backboard face 29, as seen in FIG. 3. Such mounting means may take the form—as illustrated in FIGS. 1, 3, and 4—of a removable mounting means, such as the substantially vertically extending bar 55 connected to a channel 56 containing the lower part and sides of the clock 54, at one end thereof, and having a free end 57 (see FIG. 4) at the other end. The bar 55 may slide in a channel—illustrated schematically at 58 in FIG. 4—for receipt thereof. The channel 58 may have any conventional configuration. In the embodiment illustrated in FIG. 4 the channel 58 has an interior slit 59 adapted to receive and guide a locator/stop pin 60 associated with the bar 55, with an abutment portion 61 of the channel 58 stopping the downward movement of the pin 60. Alternatively the bar 55 could be adhesively secured, or secured by fasteners, to the face 30, or to the top of the backboard 28, or the like.

As seen in FIGS. 1 and 2, the clock 54, although it is not a shot clock (24 second, 30 second, or 45 second timer as is conventional in professional, college, and international basketball play at the top of a basket) it is mounted by the bar 55 and the rest of the mounting means so that it simulates the position of a shot clock on a full size basketball backboard.

FIG. 5 shows a modification of the desk lamp of FIGS. 1 through 4. Components of the FIG. 5 embodiment are illustrated by the same reference numeral as the FIGS. 1 through 3 embodiment only preceded by a "1". The only significant differences between this embodiment and the FIGS. 1-4 embodiment is that no clock is provided, actual functional braces 141 are provided rather than simulating elements 41, the electrical switch 115 is positioned on the bottom portion 117 at the base 111, and the linear actuator 146 is different. In this case the linear actuator 146 comprises first and second rods 148 which extend into a central tube 63 and make a friction fit with interior friction elements within the tube 63 such as the O-rings (of rubber-like elastomeric material) 64.

FIGS. 6 through 8 illustrate another exemplary novelty device according to the present invention. The device illustrated in FIGS. 6 through 8—and shown generally by reference numeral 66—comprises a novelty clock which is designed to simulate a basketball standard backboard assembly having a shot clock associated therewith. In this embodiment structures similar to those illustrated in FIGS. 1 through are shown by the same reference numeral only preceded by a "2". The major elements are the miniature basketball backboard 228, rim 231, and net 232, the rim 231 extending from the first face 229 of the backboard 228, a rod 255 connected to the backboard 228 (e.g. by fasteners, adhesive, or molded integrally therewith if of plastic or like moldable material), a channel 256 for the clock 254, and graphics 233 imaged on the face 222. The clock 254 preferably comprises a conventional LCD clock which keeps time in a twelve or twenty-four hour cycle and has a digital display (as seen in FIG. 6) that it is visible when viewing the face 229 of the backboard 228 having a graphics 233 thereon. The clock 254 may be powered by a conventional button battery, such as seen at 68 in FIG. 8.

The novelty clock 66 also has means for mounting the backboard 228 to a support surface. The mounting means may comprise the cantilever arm 12 and base 11, such as shown in the FIGS. 1 through 3 embodiment. In FIGS. 6 through 8 the mounting means comprises a permanent magnet 69 (see FIGS. 7 and 8) which defines at least part of the backboard second face 230. For example the permanent magnet 69 may be in strip form, as illustrated in FIGS. 7 and 8, and may either be adhesively secured to the backboard 228 if it is of non-magnetic material, or magnetically secured thereto if it is of magnetic material (such as steel) or coated with magnetic material, or it may be attached to the board 228 by fasteners, or actually form part of the backboard 228. The magnet 69 is suitable for mounting the backboard 228 on a refrigerator or other substantially vertical surface.

Instead of the magnet 69 other suitable mounting means could be provided, such as one or a plurality of suction cups, permanent or repositional adhesive, hooks or hook receiving holes, or the like.

In the FIGS. 6 through 8 embodiment in order to enhance the simulation of a conventional backboard assembly provided thereby, a foam strip 70 may be provided on the face 229 along the bottom edge and part of the side edges near the bottom of the backboard 228. The foam strip 70 simulates an actual player-protecting foam strip on a full size basketball backboard when the face 229 is viewed head on as seen in FIG. 6. However there is no reason for the strip 70 to actually be provided on the bottom of the backboard 228 and extending to the rear face 229 and up the side since the only function it performs is a simulating function rather than protecting a player. Therefore it is preferably provided only on the first face 229 as seen most clearly in FIGS. 7 and 8.

The miniature backboards 228, 128, 28, and associated components including the rims 31, 131, 231, may be of any miniature size depending upon the particular article that they are part of. Typically they will be between about 1/15 and 1/4 of the size of a full size backboard assembly. In addition to providing a novelty function, with a graphics 33, 233, the devices 10, 66 according to the present invention actually can be used for amusement, such as by shooting wads of paper or other generally spherical objects—such as the conventional open cell light foam ball 72 illustrated in FIG. 7—that are capable of passing through the basket defined by the rim 231 and/or the net 232.

It will thus be seen that according to the present invention a functional object simulating a conventional basketball standard and/or backboard assembly has been provided. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A novelty desk lamp, comprising:

a base;

a miniature basketball backboard, rim and net, said rim extending from a first face of said backboard, and said backboard having a second face opposite said first face;

a cantilever arm extending from said base and operatively connected to said backboard second face;

a light source mounted adjacent said backboard second face and connectable by wires to a source of electrical power; and a control for controlling the supply of electrical power to said light source.

2. A novelty desk lamp as recited in claim 1 further comprising a digital display clock capable of keeping time from at least 1:00 to 12:59; and means for mounting said clock so that it is positioned above said backboard and the digital display thereof is visible when viewing said backboard first face.

3. A novelty desk lamp as recited in claim 2 wherein said clock mounting means comprises removable mounting means for mounting said clock to said second face of said backboard.

4. A novelty desk lamp as recited in claim 1 further comprising means for adjusting the position of said cantilever arm with respect to said base so that the position of said light source with respect to said base may be adjusted.

5. A novelty desk lamp as recited in claim 4 wherein said adjusting means comprises a pivotal connection between said cantilever arm and said base for allowing pivotal movement of said arm with respect to said base, and means for effecting pivoting action of said arm about said pivotal connection and retaining said arm in the position to which it is pivoted.

6. A novelty desk lamp as recited in claim 5 wherein said means for effecting pivoting action comprises a linear actuator having first and second opposite ends, and pivotally connected at said first end to said arm, and pivotally connected at said second end to said base.

7. A novelty desk lamp as recited in claim 6 wherein said linear actuator comprises a turnbuckle.

8. A novelty desk lamp as recited in claim 4 further comprising a weight disposed in said base for biasing said arm and backboard so that said backboard front face is maintained substantially vertical.

9. A novelty desk lamp as recited in claim 1 further comprising basketball team indicating graphics imaged on said backboard first face.

10. A novelty desk lamp as recited in claim 1 wherein said light source is in a housing, and wherein said housing is affixed to said backboard second face.

11. A novelty desk lamp as recited in claim 10 wherein said base has a horizontal surface engaging face; and wherein said cantilever arm has a first portion which extends from said base at an angle of between about 30°–60° to said base horizontal surface engaging face, and a second portion which extends substantially parallel to said base horizontal surface engaging face and is connected to said lamp.

12. A novelty desk lamp as recited in claim 11 further comprising functional braces, or elements simulating braces, connecting said arm directly to said backboard second face.

13. A novelty desk lamp as recited in claim 2 wherein said means for mounting said clock mounts said clock so that it simulates the position of a shot clock on a full size basketball backboard.

14. A novelty desk lamp as recited in claim 12 further comprising a digital display clock capable of keeping time from at least 1:00 to 12:59; and means for mounting said clock so that it is positioned above said backboard and the digital display thereof is visible when viewing said backboard first face.

15. A novelty desk lamp as recited in claim 2 wherein said control means comprises an electrical switch, and wherein said clock comprises an LCD clock powered by a button battery.

16. A novelty clock comprising:

a miniature basketball backboard, rim and net, said rim extending from a first face of said backboard, and said backboard having a second face opposite said first face;

a digital display clock capable of keeping time from at least 1:00 to 12:59;

means for mounting said clock so that it is positioned above said backboard and the digital display thereof is visible when viewing said backboard first face; and means for mounting said backboard to a support surface.

17. A novelty clock as recited in claim 16 wherein said means for mounting said backboard to a support surface comprises a permanent magnet defining at least part of said backboard second face.

18. A novelty clock as recited in claim 16 wherein said means for mounting said backboard to a support surface comprises a cantilever arm, and a base having a flat bottom for engaging a horizontal surface.

19. A novelty clock as recited in claim 16 further comprising a foam strip mounted along the periphery of the bottom and part of the sides of said first face of said backboard, simulating a player-protecting foam strip on a full size basketball backboard when said first face is viewed head on.

20. A novelty clock as recited in claim 16 wherein said means for mounting said clock mounts said clock so that it simulates the position of a shot clock on a full size basketball backboard, and wherein said clock comprises an LCD clock powered by a button battery.

* * * * *